United States Patent [19]

Claussen

[11] Patent Number: 4,627,349

[45] Date of Patent: Dec. 9, 1986

[54] HEATED INKING ROLL FOR A PRINTER

[76] Inventor: Gary J. Claussen, 3150 King Ave., #4, Billings, Mont. 59102

[21] Appl. No.: 729,878

[22] Filed: May 2, 1985

[51] Int. Cl.[4] ..... B41F 31/00

[52] U.S. Cl. ..... 101/348; 101/35

[58] Field of Search ..... 101/35, 348, 349, 350, 101/352, 36, 37, 25, 27, 219, 328, 329, 330, 331

[56] References Cited

U.S. PATENT DOCUMENTS

| | | | |
|---|---|---|---|
| 1,400,223 | 12/1921 | McDonough | 101/35 |
| 1,845,726 | 2/1932 | Scott | 101/37 |
| 1,916,661 | 7/1933 | Flothow | 101/329 X |
| 2,344,610 | 3/1944 | Hargreaves et al. | 101/36 |
| 2,442,673 | 6/1948 | Bailey et al. | 101/36 X |
| 2,601,826 | 7/1952 | Huntar et al. | 101/35 |
| 2,778,296 | 1/1957 | De Koning | 101/37 X |
| 2,971,460 | 2/1961 | Shindle | 101/426 X |
| 3,140,656 | 7/1964 | Shook | 101/35 |
| 3,709,048 | 1/1973 | Stepanek et al. | 101/352 X |
| 3,736,870 | 6/1973 | Johnson et al. | 101/348 X |

*Primary Examiner*—Clifford D. Crowder
*Attorney, Agent, or Firm*—Robert S. Smith

[57] ABSTRACT

Apparatus for applying ink to a printing element such as a grade stamp which includes apparatus for supporting an associated generally cylindrical ink roll for rotational movement and apparatus for heating the associated ink roll. The apparatus for heating is disposed within the apparatus for supporting and also within the associated ink roll disposed on the apparatus for mounting.

14 Claims, 5 Drawing Figures

HEATED INKING ROLL FOR A PRINTER

BACKGROUND OF THE INVENTION

The invention relates to printing apparatus and particularly to the aspect of such apparatus for applying ink to a surface on which an image is disposed which is to be applied to another surface. While the invention has particular application to flexotype apparatus and particularly to such apparatus utilized for marking lumber, it will be understood the invention also has application to other printing apparatus. In flexotype printing apparatus, ink disposed on a first roller is applied to a second roller on which an image is disposed. The image on the second roller is then passed over the lumber or other surface on which the image is to be printed. This is in contrast to offset printing in which print ink on a first roller is applied to a second roller which is then applied to a roller on which the image to be printed is disposed.

In the lumber and panel industry there is a requirement to identify individual pieces of lumber and panels with grade markings. Some prior art apparatus does use a roll which has a substantially solid circumferential face in which the ink is disposed. This arrangement is in contrast to liquid ink feeding apparatus. The ease with which the ink is transferred to the printing element or image before it is transferred from the image to a piece of lumber is of great importance. If proper inking occurs, the ink is tranferred and a complete image will be produced on the lumber. If too much or too little ink is transferred, the printing will be illegible on the lumber.

The prior art apparatus has used ink rolls of the same general type as that used in the present invention with external sources of heat to promote the proper flow of ink out of the roll and onto a printing element. Typical external sources include heaters such as electrical resistance heaters and infra-red lamps. The apparatus used in the prior art suffers from several disadvantages. An approach which heats the entire area of the roll inherently consumes a large quantity of energy while being relatively ineffective in placing the heat at the precise location of the ink roll where it is most needed. Still other problems with such heaters result from the location of the space heaters or infra-red lamps which may result in physical damage to the heaters or lamps. In still other cases the heaters or lamp may be inadvertently positioned so close to the ink roll that the ink roll will begin to smoke because the source of heat is too close.

Another problem encountered with the prior apparatus is that the use of such external heaters mandates the use of a relatively small diameter ink roll which results in a relatively sort service life and, thus, relatively high cost. It will be understood that in the existing apparatus the ink rolls must be replaced at intervals as short as one hour.

Still another problem with the prior art apparatus is that it is sensitive to the ambient temperature and, thus, typically will not work well in cold temperatures and, more specifically, will not work well in the cold temperatures which are commonly encountered in many logging areas.

It is an object of the present invention to minimize power consumption and eliminate heat lamps and space heaters and, thus, consequential breakage of such heating sources as well as to more effectively heat the interior of the ink roll.

It is another object of the invention to provide apparatus which will enable the use of relatively larger diameter ink rolls than was possible when utilizing the prior art structures, which will result in lower costs.

It is still another object of the invention to provide apparatus which will function well despite the ambient temperature.

SUMMARY OF THE INVENTION

It has now been found that these and other objects of the invention may be attained in apparatus for applying ink to a printing element such as a grade stamp which includes means for supporting an associated generally cylindrical ink roll for rotational movement and means for heating the associated ink roll. The means for heating is disposed within the means for supporting and also within the associated ink roll disposed on the means for mounting.

In some forms of the invention the means for mounting may include means pivotally mounting the associated ink roll and means for urging the ink roll against the printing element. The means for urging may comprise a rigid adjustable stop. The means for heating may comprise an electric resistor heater and the means for holding may comprise first and second arms having a pivotal connection therebetween. In various forms of the invention the apparatus may further include spring biasing means, urging the ink roll away from the printing element. The pivotal connection between the first and second arms may include a split collar. The adjustable stop means may be fixed to a part of the split collar and the stop may engage the second arm. The first arm may include means for mounting on a grading machine. The means for supporting may include a bushing through which heat is conducted. A thermostat may sense the temperature of the second arm to control the temperature of the bushing.

BRIEF DESCRIPTION OF THE ACCOMPANYING DRAWING

The invention will be better understood by reference to the accompanying drawing in which.

DESCRIPTION OF THE PREFERRED EMBODIMENT

Figure 1:
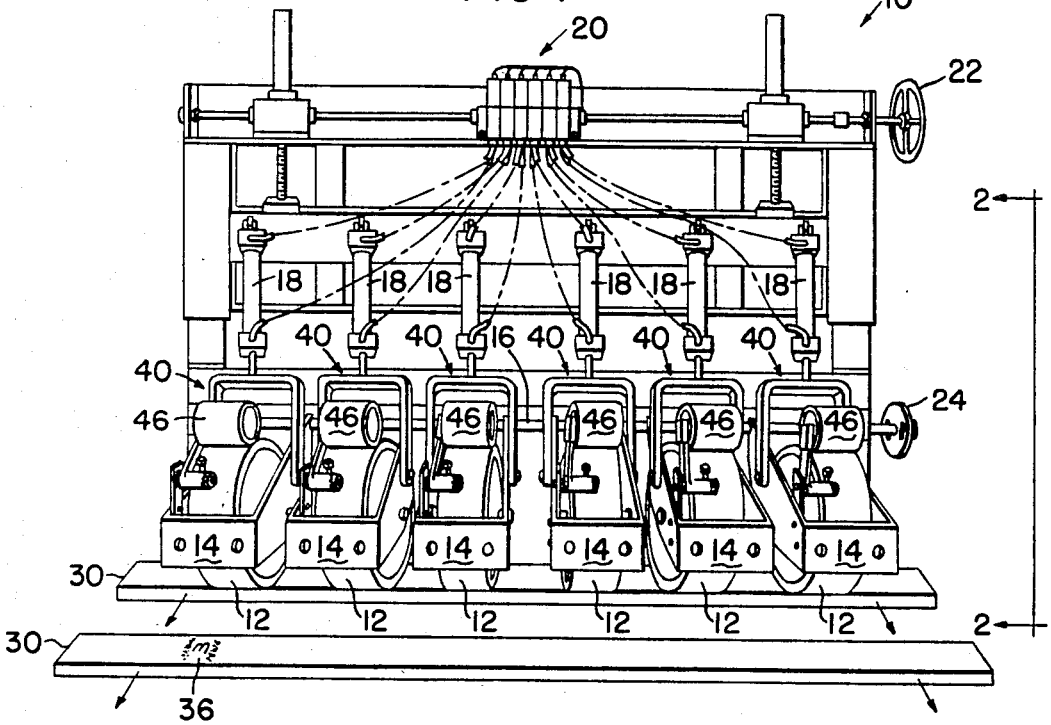
FIG. 1 is a front elevational view of a typical six position grading machine for face marking up lumber.
Figure 2:
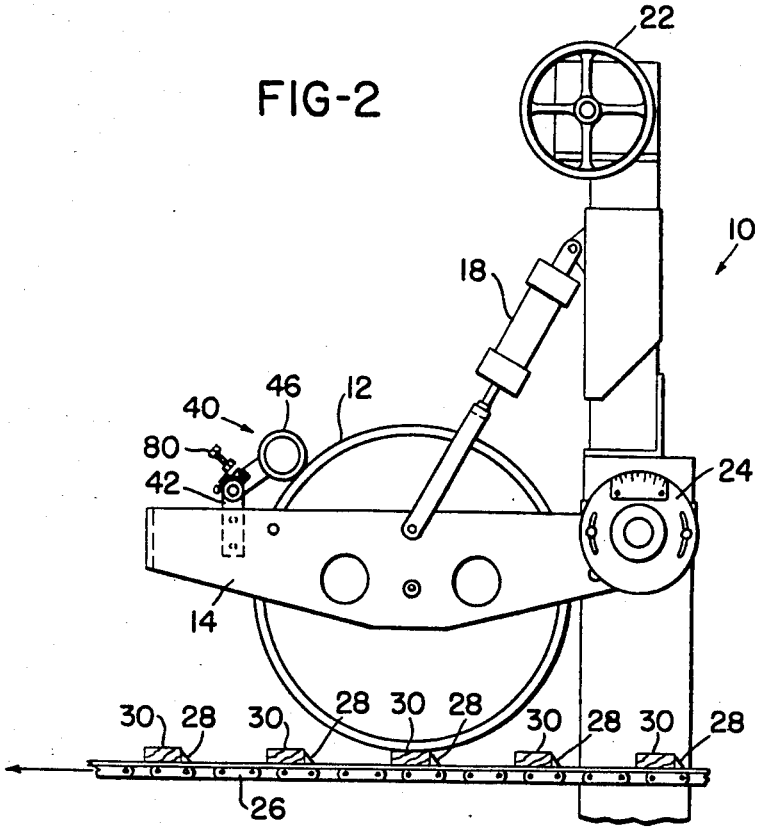
FIG. 2 is a side view taken along the line 2—2 of FIG. 1.

Referring now to FIGS. 1 and 2 there is a shown a six position grading machine 10 which includes six grade stamp wheels 12. Each grade stamp wheel 12 is mounted on a support 14. Each support 14 is pivotally supported on a common shaft 16. Each support 14 carries the grade stamp wheel 12 for rotation about an axis. Each support 14 is raised and lowered by a respective pneumatic cylinder 18 which is in turn controlled by an array 20 of solenoid valves. The grading machine 10 includes a frame positioning screw and a hand wheel 22, as well as a mark centering dial 24.

Each chain 26 is provided with axially spaced dogs 28 which engage the side, for example, of a piece of lumber 30 to advance that piece of lumber 30 under each of the six grade stamp wheels 12 simultaneously. Each of the grade stamp wheels 12 has a different logo 36 corresponding to different grades. One of the six grade stamp wheels 12 is actuated for each piece of lumber 30 and, accordingly, a single grade or other logo 36 is applied to each piece of lumber 30.

Figure 3:
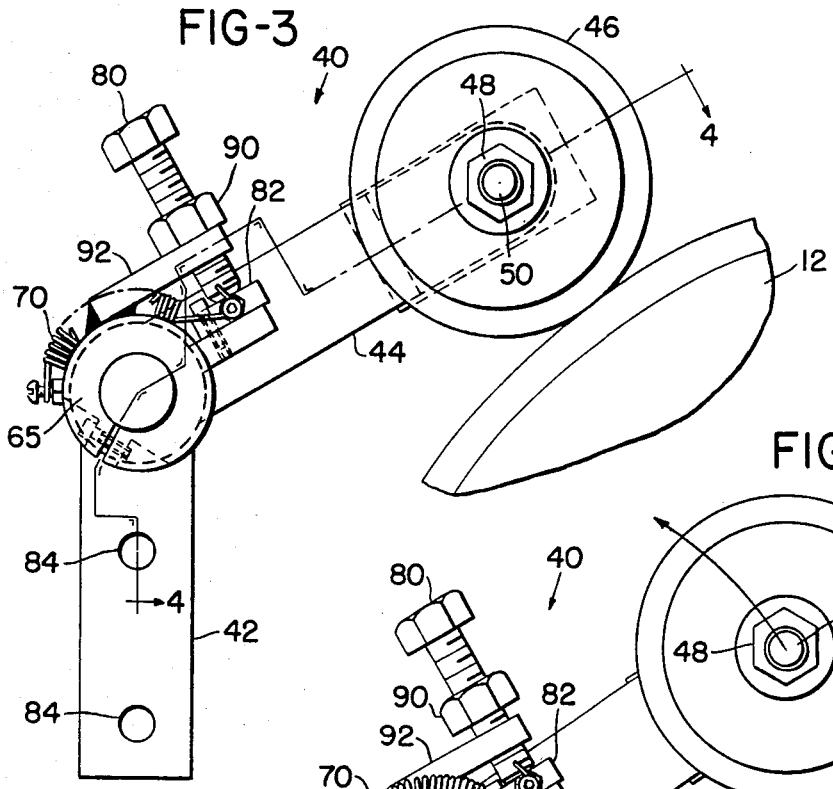
FIG. 3 is a side elevational view to a larger scale of the ink apparatus for applying ink, which is also shown in FIG. 1.
Figure 5:
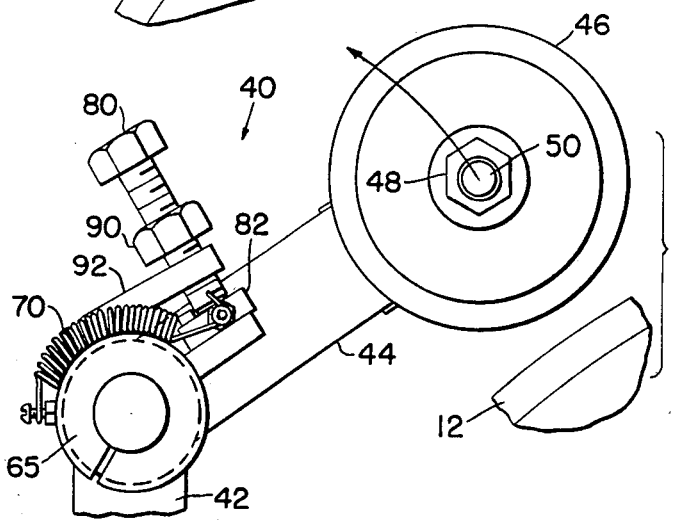
FIG. 5 is a fragmentary elevational view similar to FIG. 3 with the adjustable stop backed off to prevent raising the arm to which the ink roll support member is attached so that the ink roll may be replaced.
Figure 4:
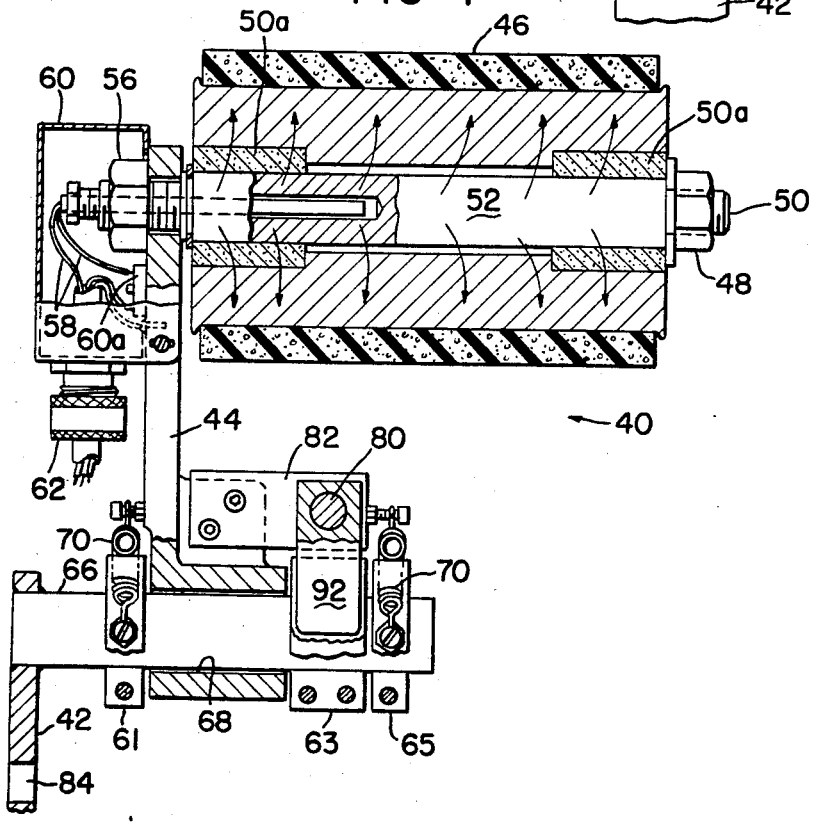
FIG. 4 is a partially sectional view taken along the line 4—4 of FIG. 3.

Referring now to FIGS. 3–5, the inking apparatus 40 will now be described in greater detail. In the preferred embodiment the inking apparatus 40 includes a first elongated member or arm 42 which is pivotally connected to a second member or arm 44. An ink roll 46 is mounted for rotation about the right extremity, as viewed in FIGS. 3 and 5, of the second member or arm 44. A collar nut 48 engages an ink roll shaft 50 and permits rapid replacement of the ink roll 46.

The central stationary shaft 50 of the ink roll 46 has an electric resistance heater 52 disposed within it in coaxial relationship. Bushings 50*a* transfer heat from the shaft 50 to the left extremity, as viewed in FIG. 4, of the ink roll shaft 50 which extends through the second member or arm 44 and is secured thereto by a lock nut 56 through which the electric resistance heater 52 extends. Connected thereto are respective wires 58 which pass through an electric enclosure box 60 to a connector 62, which has a cable which extends to a power supply (not shown). A thermostat 60*a* senses the temperature of the arm 44 and, thus, makes a relative or indirect measurement of the temperature in a bushing or journal bearing 68. The connection between the first and second members or arms 42, 44 includes three adjustable split collars 61, 63, 65, which are clamped to a shaft 66 which is welded to the first elongated member 42. The second member 44 is provided with the journal bearing 68, which engages the stationary shaft 66. Coil springs 70, 70 engage the split collars 61, 65 and, either directly or indirectly, the second member 44 so as to bias the ink roll 46 in a direction away from the grade stamp wheels 12. An adjustment screw 80, which is most clearly shown in FIG. 3, bears on a screw adjustment plate 82 to provide a positive engagement between the ink roll 46 and the grade stamp wheel 12. Thus, unlike some prior art apparatus which use a spring to bias the ink roll 46 against the grade stamp wheel 12, the present invention utilizes a positive adjustable mechanical stop for the adjustment screw 80 to positively urge the ink roll 46 against the grade stamp wheel 12. As best shown in FIG. 4, the adjustment screw 80 bears on the screw adjustment plate 82. That plate 82 extends to the right (as shown in FIG. 4) as does the ink roll 46. The coil springs 70, 70 are provided merely to avoid having the ink roll 46 and the second member 44 flop around without any definite bias. The adjustment screw 80 is carried by a bracket 92, which is fixed by the split collar 63 to the shaft 66.

In operation the adjustable stop adjustment screw 80 urges the second member 44 downwardly (in the FIG. 3 view) and thus urges the ink roll 46 against the grade stamp wheel 12. The first member 42 is mounted by bolt holes 84 to the support 14.

As best seen in FIG. 5, a lock nut 90, securing the adjustment screw 80, may be backed away from the bracket 92 so that the adjustment screw 80 may be backed outwardly and thus allow the ink roll 46 to raise away from the grade stamp 12 for easy change of the ink roll 46, as best seen in FIG. 5.

Accordingly it will be seen that the apparatus consumes little power, will work better even in cold weather, and will achieve the other objects of the invention.

The invention has been described with reference to its illustrated preferred embodiment. Persons skilled in the art may, upon exposure to the teachings herein, conceive variations in the mechanical development of the components therein. For example, the print roll 46 may provide other spring biased structure for holding the print roll 46. Other embodiments of the invention include a spring loaded design in which the adjusting bolt is attached to the ink roll system. Such variations are deemed to be encompassed by the disclosure, the invention being delimited only by the appended claims.

Having thus described my invention, I claim:

1. Apparatus for applying ink to a printing element such as a grade stamp, which comprises:

means for supporting an associated generally cylindrical ink roll for rotational movement and means for heating the associated ink roll, said means for heating being an elongated electric resistance heating element disposed within said means for supporting and also within the associated ink roll disposed on said means for supporting, said means for supporting including a bushing through which heat is conducted, said bushing extending in axially overlapping relationship to said elongated elastic resistance heating element and the associated ink roll, and said electric resistance elongated heating element being in substantially coaxial relationship with said ink roll whereby heat is transferred radially from said electric resistance heating element to the ink roll.

2. The apparatus as described in claim 1, wherein:

said means for supporting includes means pivotally mounting the associated ink roll, and means for urging said ink roll against a printing element, said means for urging comprising a rigid adjustable stop.

3. The apparatus as described in claim 2, wherein:

said means for heating said ink roll comprises an electric resistance heater.

4. The apparatus as described in claim 3, wherein:

said means for supporting comprises first and second arms having a pivotal connection therebetween

5. The apparatus as described in claim 4, wherein:

said apparatus further includes spring biasing means urging said ink roll away from said printing element.

6. The apparatus as described in claim 5, wherein:

said pivotal connection between said first and second arms includes a split collar.

7. The apparatus as described in claim 6, wherein:

said adjustable stop is fixed to a part of said split collar and said stop engages said second arm.

8. The apparatus as described in claim 7, wherein:

said first arm includes means for mounting on a grading machine.

9. The apparatus as described in claim 8, wherein:

a thermostat senses the temperature of said second arm to control the temperature of said bushing.

10. The apparatus as described in claim 9 wherein:

said bushing is made of graphite.

11. Apparatus for applying ink to a printing element such as a grade stamp, which comprises:

means for supporting an associated generally cylindrical ink roll for rotational movement and means for heating the associated ink roll, said means for heating being disposed within said means for supporting and also within the associated ink roll disposed on said means for supporting, said means for supporting including means pivotally mounting the associated ink roll, and means for urging said ink roll against a printing element, said means for urging comprising a rigid adjustable stop;

said means for heating said ink roll comprises an electric resistance heater;

said means for supporting comprises first and second arms having a pivotal connection therebetween;

said apparatus further includes spring biasing means urging said ink roll away from said printing element;

said pivotal connection between said first and second arms includes a split collar; and said adjustable stop is fixed to a part of said split collar and said stop engages said second arm.

12. The apparatus as described in claim 11, wherein:

said first arm includes means for mounting on a grading machine.

13. The apparatus as described in claim 12, wherein:

said means for supporting includes a bushing through which heat is conducted.

14. The apparatus as described in claim 13, wherein:

a thermostat senses the temperature of said second arm to control the temperature of said bushing.

* * * * *